US007179130B2

(12) United States Patent
Judge et al.

(10) Patent No.: US 7,179,130 B2
(45) Date of Patent: Feb. 20, 2007

(54) SOLENOID CONNECTOR

(76) Inventors: Kerry J. Judge, 3740 Irwin St. E., Safety Harbor, FL (US) 34695; Timo E. Rantikallio, Olarsvag 7, Langshyttan (SE) 770 70

( * ) Notice: Subject to any disclaimer, the term of this patent is extended or adjusted under 35 U.S.C. 154(b) by 226 days.

(21) Appl. No.: 10/610,219

(22) Filed: Jun. 30, 2003

(65) Prior Publication Data

US 2004/0005818 A1 Jan. 8, 2004

Related U.S. Application Data

(60) Provisional application No. 60/392,764, filed on Jul. 1, 2002.

(51) Int. Cl.
*H01R 25/00* (2006.01)

(52) U.S. Cl. ..... 439/638; 439/188; 439/225

(58) Field of Classification Search ..... 439/638, 439/650–652, 655, 660, 188, 225; 200/51.09
See application file for complete search history.

(56) References Cited

U.S. PATENT DOCUMENTS 3,315,214 A * 4/1967 Davis ..... 439/578
3,626,354 A * 12/1971 Banner ..... 439/105
4,415,217 A * 11/1983 Clabburn et al. ..... 439/488
5,118,301 A * 6/1992 Bentivolio ..... 439/188
5,305,173 A 4/1994 Kakuta et al.
6,171,125 B1 1/2001 Kirkendall
6,206,711 B1 * 3/2001 Snow et al. ..... 439/225
6,361,333 B1 * 3/2002 Cash, Jr. ..... 439/106
6,416,362 B1 * 7/2002 Conrad et al. ..... 439/651
6,500,025 B1 * 12/2002 Moenkhaus et al. ..... 439/502

* cited by examiner

*Primary Examiner*—P. Austin Bradley
*Assistant Examiner*—Edwin A. Leon
(74) *Attorney, Agent, or Firm*—Christopher Paradies; Fowler White Boggs Banker P.A.

(57) ABSTRACT

The present invention discloses a device for electrically connecting an external device into a circuit running from an apparatus control switch, to an apparatus, thus allowing the interception and redirection of the control signal to the external device. It concerns a simple, completely enclosed, error-proof connector which allows for simultaneous operation of the apparatus and the external device.

17 Claims, 5 Drawing Sheets

SOLENOID CONNECTOR

CROSS-REFERENCE TO RELATED APPLICATION

The present application claims the benefit of previously filed co-pending Provisional Patent Application, Ser. No. 60/392,764.

FIELD OF THE INVENTION

The present invention relates to the field of electrical connections. More specifically, it relates to a device for electrically connecting an external device into a circuit running from an apparatus control switch, to an apparatus, thus allowing the interception and redirection of the control signal to the external device. It concerns a simple, completely enclosed, error-proof connector which allows for simultaneous operation of the apparatus and the external device.

BACKGROUND OF THE INVENTION

In the equipment control industry, it is common for an apparatus having a solenoid to be controlled by an apparatus control switch. One conventional configuration is shown in FIGS. 1A and 1B. In normal operation, a user controls the operation of apparatus by activating an apparatus control switch 60, which causes an electrical signal to be sent via a first connector 60 coupled with a second connector 80 to apparatus solenoid 83 which then powers the apparatus.

Typically, such an apparatus control switch 60 is connected to apparatus solenoid 83 by either a three-pin or four-pin connection. For example, an apparatus solenoid may have a three-pin male connector 80 which inserts into the three-pin female connector 60 of an apparatus control switch, as shown in FIG. 1. In the three pin female connector 60 of the apparatus control switch, there is included a "hot pin" 60A, often referred to as a "#1 pin" by those familiar in the art; a "ground" pin 60B, often referred to as a "#2 pin", which is ordinarily disposed directly across from the hot pin on the same side of the connector; and a "line-up" pin 60C located between the hot pin and the ground pin, for use in lining up the female pins of apparatus control switch 60 with the male pins of apparatus solenoid 80. Herein, female pins are actually receptacles for male pins, which are prongs that are shaped to be inserted into the female receptacles. A typical apparatus will include an apparatus solenoid 83, which has three male pins 80A, 80B and 80C, which are capable of mating with the female pins 80A, 80B and 80C respectively, providing an electrical connection between the apparatus and the apparatus control switch. It is also known to use a four pin female connector 160 and a four pin male connector 180 to make an electrical connection between a control switch and an apparatus to be controlled by the control switch. FIGS. 2A and 2B show an example of a four pin arrangement, which prevents misalignment of the connection. Female pins 160A–160D are disposed such that these pins may only be mated with the male pins 180A–180D, having the same letter, i.e. A—A, B—B, C—C and D—D. As shown in FIG. 2A, two of the female pins 160A, 160B are connected to corresponding wires 161A, 161B, which lead to an apparatus control switch, for example. One receptacle 160A is for the hot pin 180A and the other receptacle 160B is for the ground pin 180B. Another of the receptacles 160C is considered a "dead" pin and mates with a dead male pin 180C, and the fourth receptacle 160D mates with an alignment pin 180D.

When it is desired to operate only the apparatus, the above standard connections serve quite adequately. There are many instances, however, in which it may be desirable to intercept the control signal that is sent from the apparatus control switch to the apparatus solenoid, and redirect that signal to another destination, such as an external appliance or measuring device, before such signal is sent back to the apparatus to be operated upon. For example, it may be advantageous to operate an external appliance simultaneously with the apparatus. In such a situation, a means of intercepting the control signal allows for simultaneous operation is needed. Likewise, it may be advantageous to introduce a delay in the signal from the apparatus operator to the apparatus by means of an external timer. Other reasons for intercepting and redirecting such a signal include measuring the strength or reliability of the control signal and other purposes well known in the art.

In order to introduce an external device into the path of the control signal, it is typical in the prior art to use a series of individual wires, where a "hot wire" is connected from the apparatus control switch hot pin to the "hot" side of the external device, and a "ground wire" from the ground of the external device to the "ground pin" on the apparatus solenoid. However, such an arrangement leaves all such individual wires exposed, thus creating a hazardous situation. Moreover, such connections are not protected from the elements or from being knocked loose by mechanical shock, which is not only inconvenient but also potentially dangerous.

OBJECTS AND SUMMARY OF THE INVENTION

A solenoid connector that prevents the dangers of electrocution and prevents failure from open or short circuits of the connectors is desired that does not require adoption of a new standard pin configuration.

It is an object of the present invention to allow the users of an apparatus to intercept the signal between the apparatus control switch and the apparatus, and re-route that control signal to an external device.

BRIEF DESCRIPTION OF THE DRAWINGS

The invention will now be described, with respect to embodiments shown in the drawings and described in preferred embodiments.

DETAILED DESCRIPTION OF PREFERRED EMBODIMENTS

Figure 1A:
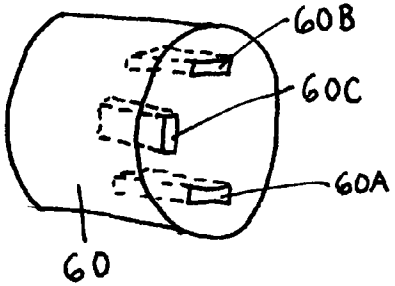
(PRIOR ART) FIGURE 1A
FIG. 1 depicts the male and female pin configurations of a conventional 3-pin solenoid connector.

The present invention will now be described more fully hereinafter with reference to the accompanying drawings, in which examples of the invention are disclosed. The components of the disclosed examples may be arranged and designed in many varied configurations. The present invention may be embodied in many different forms and should not be construed as limited to only the examples set forth herein but only by the language of the claims that issue. The examples are provided to fully disclose the scope of the invention and are merely representative of some preferred embodiments of the invention. Like reference characters indicate similar corresponding items throughout the several views of the drawings.

Figure 3:
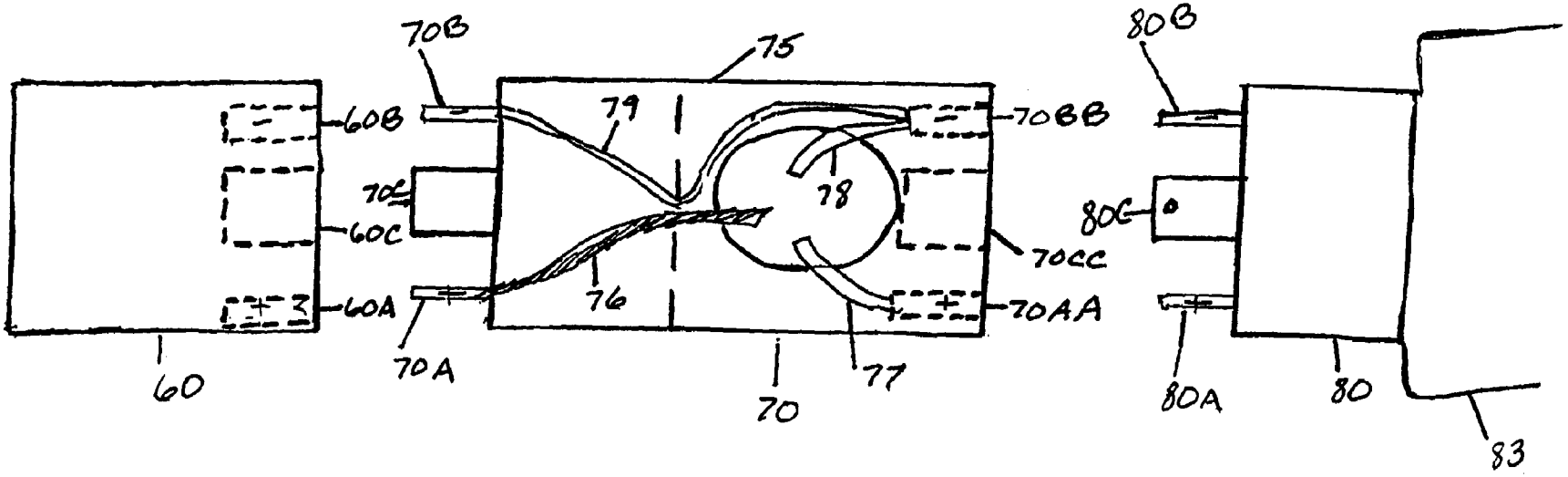
FIG. 3 depicts a top view showing an example of a 3-pin solenoid connector of the present invention aligned to connect to conventional 3-pin connectors.
Figure 4:
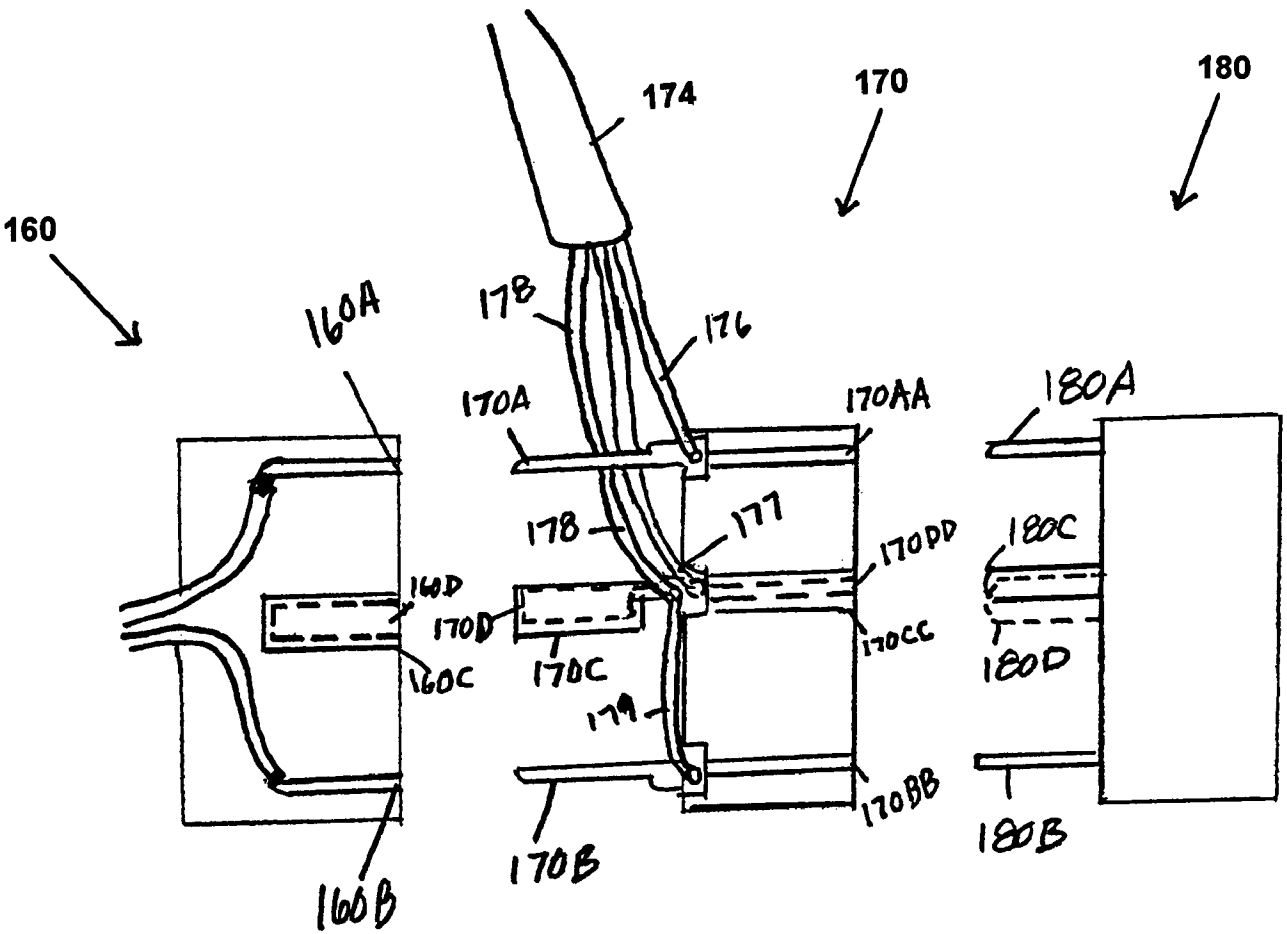
FIG. 4 depicts a top view showing an example of a 4-pin solenoid connector of the present invention aligned to connect to conventional 4-pin connectors.

Examples of the present invention include a novel solenoid connector 70, 71, such as shown in FIGS. 3–4. In its most basic form, the solenoid connector is a device for connecting two apparatuses. The device is an electrical connection for simultaneous control of two devices, such as a remote device in a circuit between a control switch and a primary device to be controlled. The control signal to the primary device is redirected to a remote device, which may redirect the signal to the primary device. For example, the solenoid connector 70,170 may be introduced into a circuit between a control switch for operating an apparatus and the apparatus to be operated, where such electrical connector intercepts the signal from the control switch and redirects the signal to a remote appliance before returning the signal to the device to be controlled.

In one example, a three-pin solenoid connector 70, such as depicted in FIG. 3, has a first side including three male pins and a second side including three female pins. On the first side, the following male pins are included: (1) first male pin, or "hot pin," 70A; (2) second male pin, or "ground" pin, 70B; and (3) third male pin, or "line-up" pin, 70C, all of which are located in the configuration typically found on a conventional three-pin solenoid as discussed above.

Figure 1B:
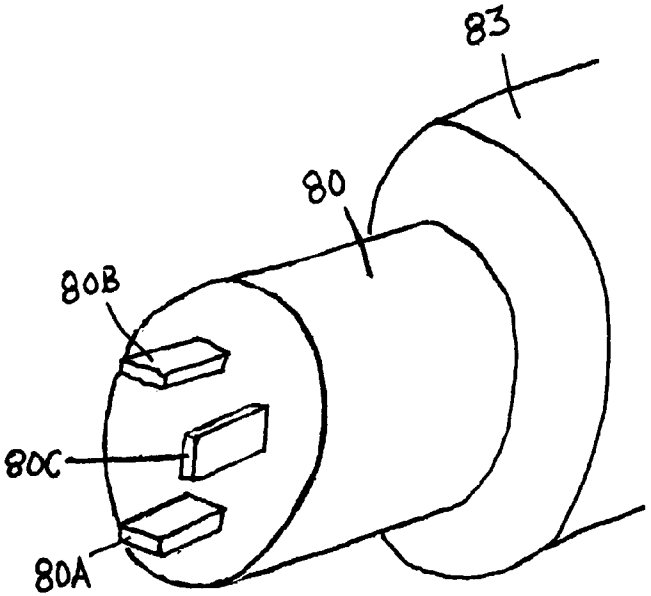
(PRIOR ART) FIGURE 1B
Figure 2B:
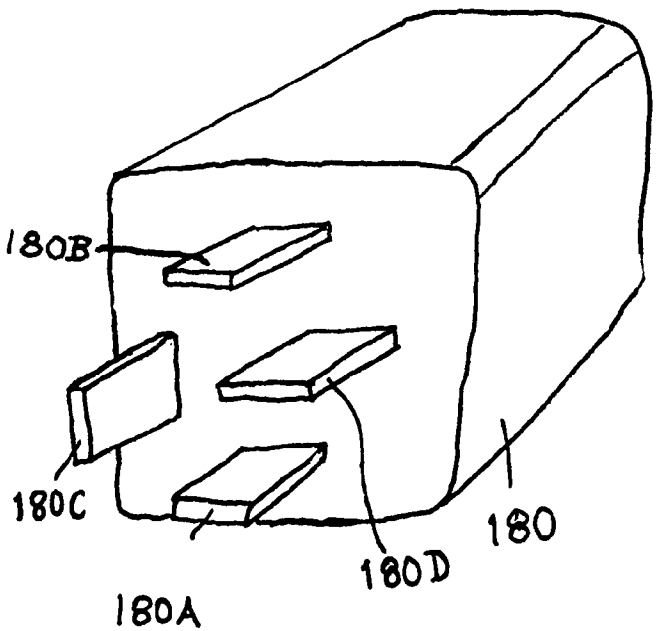
(PRIOR ART) FIGURE 2B
FIG. 2 depicts the male and female pin configurations of a conventional 4-pin solenoid connector.
Figure 2A:
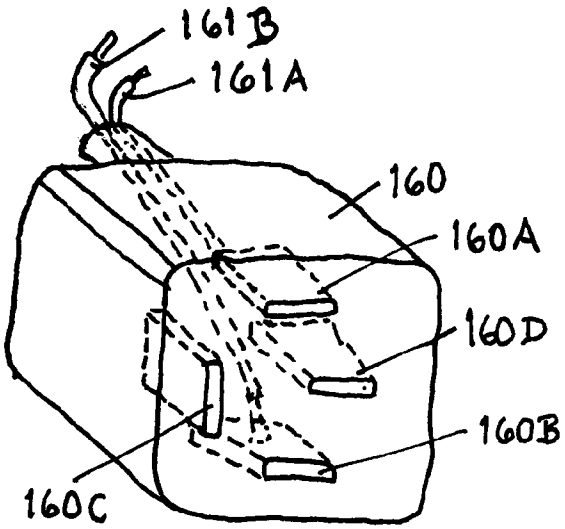
(PRIOR ART) FIGURE 2A

The solenoid connector 70 may also include three female pins, including first female pin, or "hot pin," 70AA, second female pin, or "ground" pin, 70BB, and third female pin, or "line-up" pin 70CC, all which are located in the configuration typically found on a conventional three-pin male connector 80 and female connector 60, such as shown on FIG. 1. In such a configuration, the female pins are configured to accept the male pins 80A–80C of a conventional apparatus solenoid 83.

Attached to the external casing 75 of connector 70 is a cord (not shown). Within the cord are electrical conductors, such as electrical wires, which allow for the transfer of electrical signals received by male pins 70A–70C to be transferred to a remote location, and then to be returned to the female pins 70AA–70CC of the novel solenoid connector of the present invention.

In the preferred embodiment of the three-pin unit of the present invention, cord 76 contains hot feed wire, 76; second conductor, or hot return wire, 77, and third conductor, or ground wire, 78. Hot feed wire 76 is in electrical connection on one end with hot pin 70A. The other end of hot feed wire 76 may be exposed to allow for field connection to any external device or other item located remotely from apparatus 83. Hot return wire 77 is in electrical connection with female hot pin 70AA on one end, and may be exposed on the other end, allowing for field connection to any external device or other item. Next, ground wire 78 is in electrical connection with female ground pin 70BB on one end, and may be exposed on the other end, thus allowing for field connection with the ground terminal of any remote apparatus or other device. Finally, located within external casing 75 is a direct ground wire 79. By virtue of direct ground wire 79, male ground pin 70B is in electrical connection with female ground pin 70BB.

With respect to the three-pin connector shown in FIG. 3, except where noted, there is no direct connection between a male pin on the first side of the connector and a correspondingly located female pin. This is in contrast to the example of a four-pin connector, as shown in FIG. 4 and described herein, in which each male pin on the one side of the connector extends directly through the connector and is in mechanical and electrical connection with the corresponding female slot on the other side of the connector. More specifically, the male pins of the three-pin unit do not extend through the center of the connector body, but instead rely on conductors, such as wiring, for any connections which may exist between a male pin and a female pin. However, in alternative embodiments, a male pin could extend through the connector body to the corresponding female pin, for example, as may be appropriate for the connection between male ground pin 70B and female ground pin 70BB.

It should be noted that the third male line-up pin, 70C, is not in electrical contact with third female line-up pin 70CC, for example.

As discussed in the Background section, it is also common in the industry for the connection between apparatus control switch 60, 160 and apparatus solenoid 80, 180 to utilize four pins, rather than three. As such, another example of the solenoid connector of the present invention has four terminals on each side. The physical and electrical configuration of the four-pin example of FIG. 4, however, differs in several respects from the three-pin connector of FIG. 3.

Figure 5:
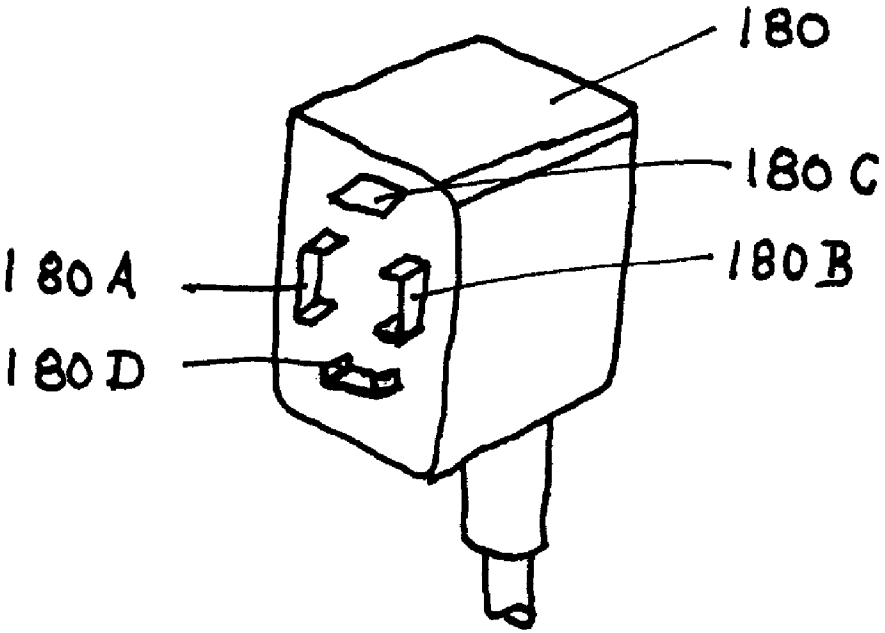
(PRIOR ART) FIGURE 5
FIG. 5 depicts a view of an example of the pin shapes of a typical 4-pin solenoid connector.

The standard industry connections which utilize four-pin connectors are depicted in FIG. 5. As can be seen with reference to FIG. 5, a standard control switch and a standard solenoid connector typically have three prongs which are slightly curved inward, and a fourth prong which is straight. In addition, the straight pin is also wider than a typical curved pin. As a result of these differences, there is a reduced likelihood that a user will connect an apparatus control switch to an apparatus solenoid in any manner other than as intended by the manufacturer.

The example connector of FIG. 4 takes into account these differences. Specifically, one of the male and female terminals are physically straight, while the remaining six prongs have a slight curve inward. This configuration likewise results in a connector that cannot be incorrectly connected. As a result, a user is prevented from incorrectly connecting the solenoid connector 80 to either the apparatus control switch or the apparatus solenoid.

In addition to having a pin configuration that prevents the four-pin unit from being connected improperly, there is another safety feature which serves to reduce the likelihood that a user will mistakenly attempt to use a three-pin connector when a four-pin connector is called for. Specifically, the casing of the three-pin connector of the preferred embodiment is rectangular, whereas the casing of the four-pin connector is square. Such casing shapes are also standard in the industry for three- and four-pin connections. As a result, users will immediately know by its shape whether a given connector is the appropriate connector for a given application.

The four-pin connector 170, as depicted in FIG. 4, has a connector body that is not shown for ease of disclosing the electrical connections and having a first side including four male pins and a second side including four female pins. On the first side are the following male pins: (1) first male pin, or "hot" pin," 170A; (2) second male pin, or "ground" pin, 170B; (3) third male pin, or "line-up" pin, 170C; and (4) fourth male pin, or "dead" pin, 170D. All four of the male pins of solenoid connector 170 are configured so as to be insertable into corresponding female pins 160A–160D of a typical four-pin apparatus control switch 160. It should be noted that FIG. 4 is a side view or top view, as opposed to a perspective view, and as such those elements of the present invention which are blocked from view by other elements that are closer to the viewer are shown by dashed lines and slightly offset. For example, element 170D is lined up adjacent to element 170C in the preferred embodiment, but element 170D is shown in dashed lines and slightly offset as compared to element 170C in FIG. 4. A similar depiction is utilized to better illustrate element 180D, which is adjacent to 180C in the preferred embodiment.

Also included on solenoid connector 170 are four female pins, including first female pin, or "hot pins" 170AA; second female pin, or "ground" pin, 170BB; third female pin, or "line-up" pin, 170CC; fourth female pin, or "dead" pin, 170DD. It should be noted that by virtue of the male pins extending through the body of the connector and being in contact with the corresponding female pin on the opposite side of the connector, each male pin is in electrical and physical contact with the corresponding female pin. In other words, male pin 170A is in direct electrical contact with female pin 170AA, male pin 170B is in direct electrical contact with female pin 170BB, male pin 170C is in direct electrical contact with female pin 170CC, and male pin 170D is in direct electrical contact with female pin 170DD. It should be understood that a female "pin" is a receptacle for a male pin of similar shape.

Attached to the external casing (not shown) of connector 170 is cord 174. Within cord 174 are electrical conductors, such as electrical wires, which allow for the transfer of electrical signals received by male pins 170A–170D to be transferred to a remote location, and then to be returned to the female pins 170AA–170DD of the novel solenoid connector of the present invention, as described herein.

FIG. 4, cord 174 contains hot feed wire 176, hot return wire 177, and ground wire 178. Hot feed wire 176 is in electrical connection on one end with the first male hot pin 170A, and therefor also in electrical connection with first female hot pin, 170AA. The other end of hot feed wire 176 may be exposed allowing for field connection to any apparatus or a remote device located remotely from the primary apparatus.

Next, hot return wire 177 is in electrical connection with the straight male line-up pin 170C on one end, and therefor also in electrical connection with female line-up pin 170CC. The other end of hot return wire 177 may be exposed on the other end, allowing for field connection to any remote device or other apparatus.

Next, ground wire 178 is in electrical connection with male dead pin 170D on one end, and therefor is also in electrical connection with female dead pin 170DD. The other end of ground wire 178 may be exposed, thus allowing for field connection with the ground terminal of any remote apparatus or other device. Finally, located within external casing (not shown) is a direct around wire 179 connecting male ground pin 170B to male dead pin 170D, which by virtue of the male pins of the present embodiment being connected to the correspondingly located female pins, results in ground wire 179 also being in electrical connection with female ground pin 170BB and female dead pin 170DD.

Both the three-pin and four-pin embodiments may work with a variety of electrical systems, such as, for example, solenoids operating on either 12 or 24 volts, and systems employing these or other voltages fall within the scope of the present invention.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the dependent claims. It should be noted that the various elements of the present invention may be used to achieve the purposes described herein alone or in combination. Also, it should be noted that neither a device to be controlled or the solenoid associated with such device, nor an external apparatus to be included in the circuit created by the present invention, are intended to be claimed elements of the present invention, but such references are only intended to describe the context in which the invention is used, and not the structure of the present invention, unless specifically cited as a limitation in the claims that issue.

What is claimed is:

1. An intermediate connector for electrically coupling an external device between a first connector coupled to one electrical device, the first connector having prongs extending from the connector, and a second connector coupled to another electrical device, the second connector having receptacles extending into the second connector, wherein the second connector is capable of electrically connecting to the first connector by way of mating the prongs in the receptacles, the intermediate connector comprising:

a plurality of prongs, extending from one end of the intermediate connector and capable of electrically connecting with the receptacles of the second connector;

a plurality of receptacles extending into an opposite end of the intermediate connector and capable of electrically connecting with the prongs of the first connector;

a first conductor having a length and capable of being electrically coupled to the external device, the first conductor being electrically coupled at a first end of the first conductor to at least one of the plurality of prongs at a first coupling point;

a second conductor being electrically coupled at a first end of the second conductor to at least one of the plurality of receptacles at a second coupling point;

a connector body enclosing and electrically insulating the first coupling point and the second coupling point from external contact, except by one of the plurality of prongs, one of the plurality of receptacles, a distal end of the first conductor or a distal end of the second conductor, wherein the distal end of the first conductor extends from the connector body and is capable of being electrically coupled to the external device; and wherein the plurality of prongs, the plurality of receptacles, the first conductor, and the second conductor are disposed and electrically coupled such that, when the intermediate connector is inserted between the first connector and the second connector, an electric current from at least one of the prongs of the first connector is diverted to the first conductor prior to being redirected to the receptacle of the second connector to which it would have otherwise been directed if the prongs of the first connector remained directly connected to the receptacles of the second connector without insertion of the intermediate connector between the first connector and the second connector.

2. The intermediate connector of claim 1, wherein at least one of the plurality of receptacles is directly electrically connected to at least one of the plurality of prongs positioned opposite of the at least one of the plurality of receptacles.

3. The intermediate connector of claim 2, wherein each of the plurality of receptacles are disposed directly opposite of a respective one of the plurality of male prongs and directly electrically connected with the respective one of the plurality of male prongs disposed directly opposite thereof;

each of the plurality of receptacles has a first shape or a second shape, different from the first shape;

each of the plurality of prongs has a corresponding first shape or a second shape, different from the first shape, such that a prong having the first shape is capable of mating with a receptacle having the first shape, but not with a receptacle having the second shape; and at least one of the plurality of receptacles has the first shape and the respective one of the plurality of male prongs directly connected with the at least one of the plurality of receptacles having the first shape has the second shape.

4. The intermediate connector of claim 3, wherein there are four receptacles and four prongs oriented such that, when the intermediate connector is inserted between the first connector and the second connector, thereafter the second connector must be rotated 90 degrees from its normal orientation with respect to the first connector in order for the receptacles of the second connector to mate with the prongs of the intermediate connector.

5. The intermediate connector of claim 4, wherein the first end of the first conductor is electrically coupled to a first prong and a first receptacle, the first end of the second conductor is electrically coupled to a second prong and a second receptacle and the distal end of the second conductor is electrically coupled to a fourth receptacle and a fourth prong.

6. The intermediate connector of claim 5, wherein the second conductor is entirely enclosed with the connector body.

7. The intermediate connector of claim 6, further comprising a third conductor having a first end and a distal end, wherein the third conductor is electrically coupled at the first end of the third conductor to a third prong and a third receptacle, and the distal end of the third conductor extends from the connector body and is capable of being electrically coupled to the external device.

8. The intermediate connector of claim 7, further comprising a fourth conductor having a first end and a distal end, wherein the first end of the fourth conductor is electrically coupled to the fourth prong, and the fourth receptacle, and the distal end of the fourth conductor extends from the connector body and is capable of being electrically coupled to the external device.

9. The intermediate connector of claim 1, wherein at least one of the plurality of receptacles is not directly connected with any of the plurality of prongs.

10. The intermediate connector of claim 9, wherein the distal end of the second conductor extends from the connector body and is capable of electrically coupling with the external device.

11. The intermediate connector of claim 10, wherein the first conductor is coupled to a first prong, the second conductor is coupled to a first receptacle disposed opposite of the first prong, and the first prong is not electrically coupled to the first receptacle when the first conductor is not electrically coupled to the second conductor.

12. The intermediate connector of claim 11, wherein the plurality of prongs is three prongs and the plurality of receptacles is three receptacles.

13. The intermediate connector of claim 12, wherein a second receptacle is directly electrically connected to a second prong, disposed opposite of the second receptacle, within the connector body.

14. The intermediate connector of claim 13, further comprising a third conductor having a first end and a distal end, wherein the second receptacle is electrically coupled to the first end of the third conductor at a third coupling point and the distal end of the third conductor extends from the connector body and is capable of being electrically coupled to the external device.

15. The intermediate connector of claim 14, wherein the third receptacle and third prong are not electrically coupled to any other receptacles or prong and are not electrically coupled to any conductor within the connector body.

16. The intermediate connector of claim 15, wherein the connector body is cylindrical.

17. The intermediate connector of claim 16, wherein the distal ends of each of the first conductor, the second conductor and the third conductor are stripped bare and the remainder of each of the first conductor, the second conductor and the third conductor are electrically insulated from each other and from external contact.

* * * * *